US009153134B2

(12) United States Patent
Warner et al.

(10) Patent No.: US 9,153,134 B2
(45) Date of Patent: Oct. 6, 2015

(54) HANDHELD VISUAL BACK-UP GUIDANCE DEVICE AND SYSTEM FOR TRAILERS AND VEHICLES

(71) Applicants: John Warner, Mims, FL (US); Wendy Warner, Mims, FL (US)

(72) Inventors: John Warner, Mims, FL (US); Wendy Warner, Mims, FL (US)

( * ) Notice: Subject to any disclaimer, the term of this patent is extended or adjusted under 35 U.S.C. 154(b) by 258 days.

(21) Appl. No.: 13/927,829

(22) Filed: Jun. 26, 2013

(65) Prior Publication Data

US 2015/0002314 A1 Jan. 1, 2015

(51) Int. Cl.
*G08B 21/00* (2006.01)
*G08G 1/16* (2006.01)

(52) U.S. Cl.
CPC ..... *G08G 1/168* (2013.01)

(58) Field of Classification Search
CPC ..... B60D 1/36
USPC ..... 340/431, 425.5, 932.2, 691.6; 33/286; 280/477
See application file for complete search history.

(56) References Cited

U.S. PATENT DOCUMENTS

| | | | | |
|---|---|---|---|---|
| 3,893,068 | A | 7/1975 | Tucker, Jr. | |
| 5,861,814 | A * | 1/1999 | Clayton | 340/687 |
| 6,178,650 | B1 * | 1/2001 | Thibodeaux | 33/286 |

* cited by examiner

*Primary Examiner* — Jeffery Hofsass
(74) *Attorney, Agent, or Firm* — Jason T. Daniel, Esq.; Daniel Law Offices, P.A.

(57) ABSTRACT

A visual back-up guidance device and system for trailers and vehicles includes a guidance device having a durable main body, a plurality of indicators represented by a left turn indicator, a GO indicator, a STOP indicator, and a right turn indicator, a speaker and a plurality of control inputs.

A visual back-up guidance system includes the guidance device and a driver unit having another plurality of indicators represented by a left turn indicator, a GO indicator, a STOP indicator, and a right turn indicator, that is communicatively linked to the guidance device.

14 Claims, 4 Drawing Sheets

HANDHELD VISUAL BACK-UP GUIDANCE DEVICE AND SYSTEM FOR TRAILERS AND VEHICLES

TECHNICAL FIELD

The present invention relates generally to trailers, and more particularly to a device for providing visual guidance to a driver attempting to back a trailer or large vehicle into a designated area.

BACKGROUND

The statements in this section merely provide background information related to the present disclosure and may not constitute prior art.

Across the United States, hundreds of thousands of people enjoy the great outdoors through the use of RV's (Recreational Vehicles) each year. To this end, RV's typically consist of two distinct types of vehicles, the pull-behind and the motorhome. Pull-behind vehicles are trailers which are hitched to a tow vehicle and are pulled to the camping destination. These vehicles (also called campers) typically range from small pop-up tents and travel trailers, to large 5th wheel trailers, and/or towed house trailers, for example. Likewise, motorhomes can range from generally small class-C units, to extremely large and luxurious class-A units which can exceed 40 feet in length. Motorhomes also commonly tow dinghy vehicles for use at the camping location.

In either instance, one problem familiar to drivers of these types of vehicles is the difficulty experienced while attempting to back into a parking space or designated campsite. While difficult to perform in daylight, the process is exceptionally difficult at night, especially if the campsite is not well lit. As such, many drivers rely on spotters (typically a spouse or other family member) to stand behind the trailer and attempt to guide the driver back into the designated space. During this procedure, cellular telephones are often used to provide voice communication between the driver and the spotter. However, as many campsites are located in remote areas where cellular service is unavailable, sometimes the spotter and driver must shout back and forth to communicate with each other. When arriving late at night it is not desirable speak loudly, as this can be a nuisance to the neighboring campsites.

Accordingly, there remains a need for a visual back-up guidance device and system for trailers and vehicles that can assist both the vehicle driver and spotter to communicate in a novel fashion without suffering from the drawbacks discussed above.

SUMMARY OF THE INVENTION

The present invention is directed to a visual back-up guidance device and system for trailers and vehicles. One embodiment of the present invention can include a device for operation by a spotter having a durable main body, a plurality of indicators for providing visual instructions to a driver, a speaker, and a plurality of control inputs for allowing the spotter to operate the plurality of visual indicators and the speaker.

Another embodiment of the present invention can include a driver unit having a plurality of indicators that is communicatively linked to the device for receiving spotter instructions and providing visual instructions to the user.

Yet another embodiment of the present invention can include a system having the device and driver unit described above.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
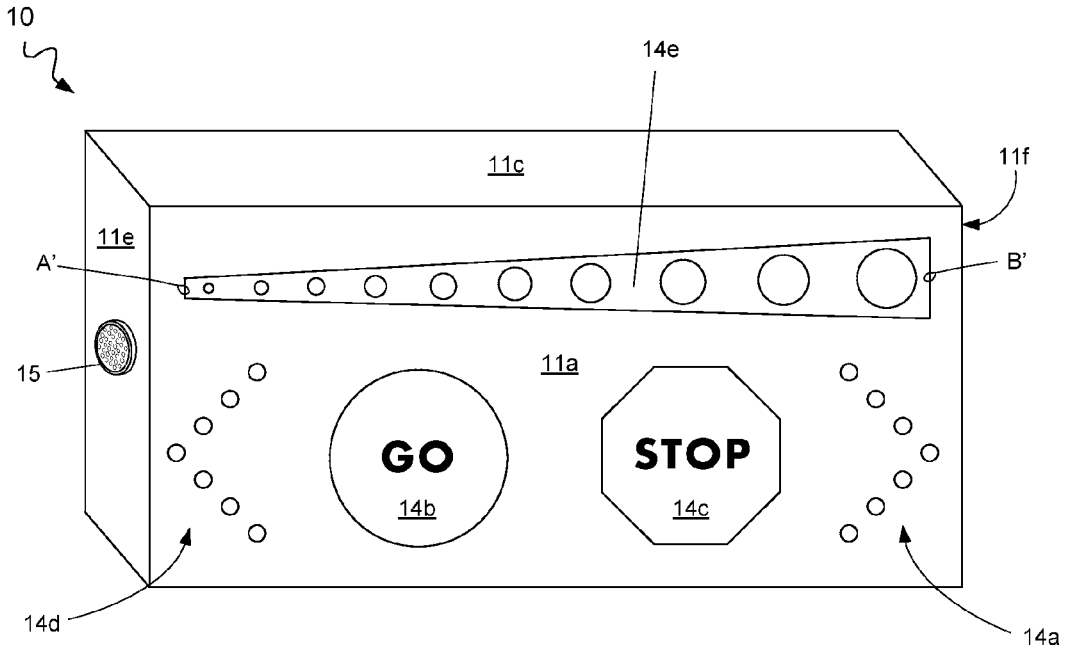
FIG. 1 is a front side view of a visual back-up guidance device for trailers and vehicles, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Although described throughout this document as pertaining to the RV industry for use with trailers and tow-vehicles, the inventive concepts disclosed herein are not so limited, as the device, system and any associated methods can be utilized in any situation wherein visual directions from a spotter to a driver would be useful.

Figure 2:
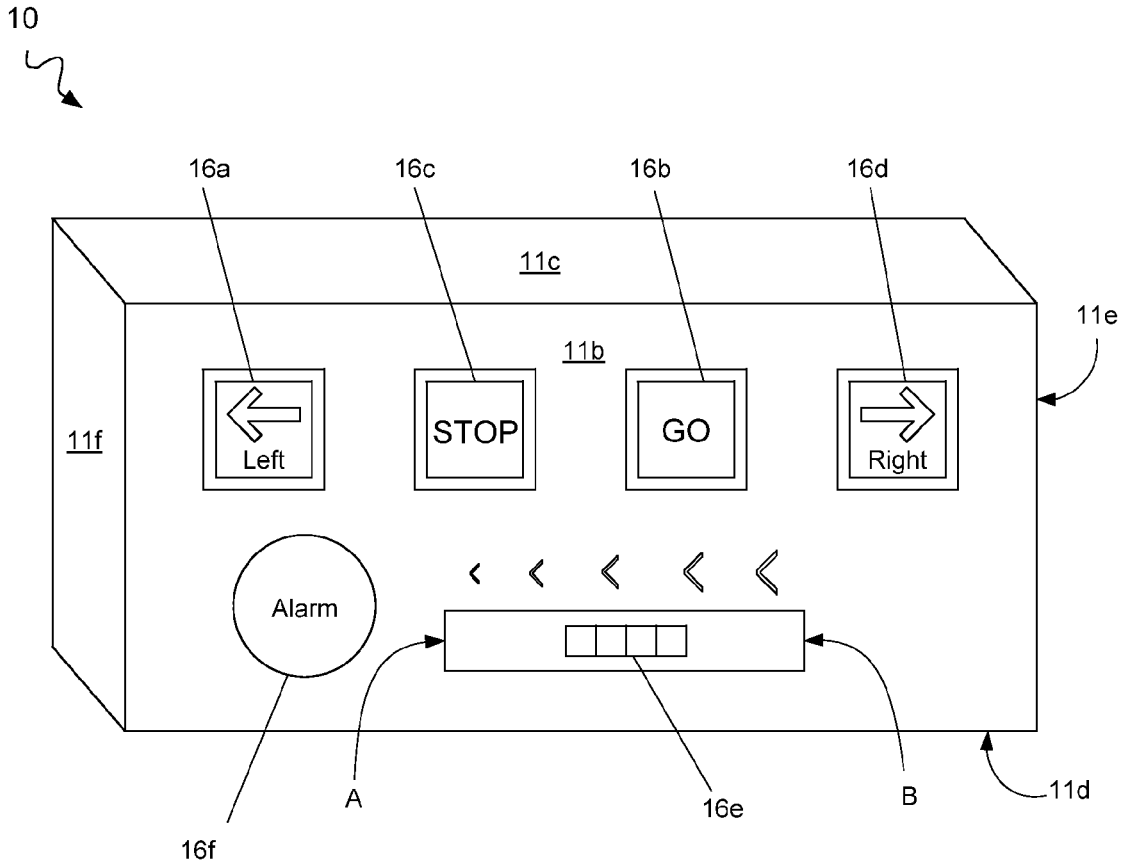
FIG. 2 is a back side view of a visual back-up guidance device for trailers and vehicles, in accordance with one embodiment of the invention.
Figure 3:
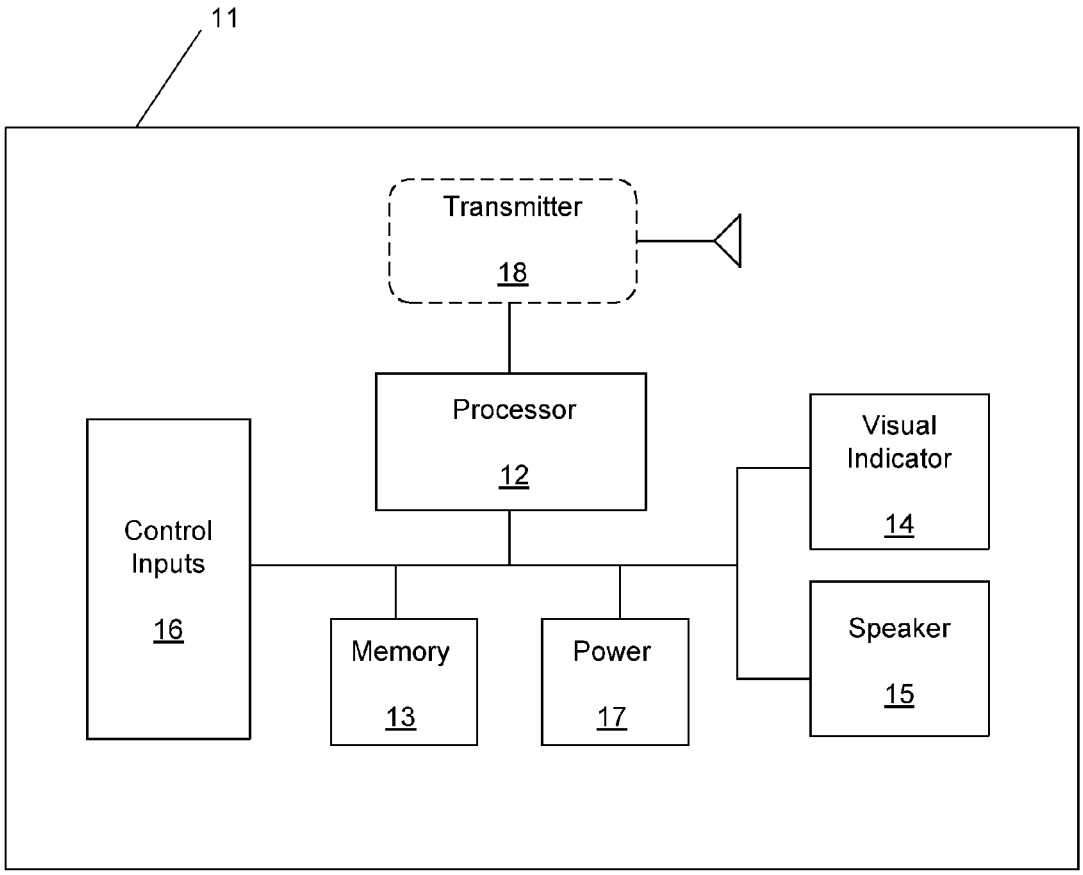
FIG. 3 is a schematic block diagram of the visual back-up device, according to one embodiment of the invention.

FIGS. 1, 2 and 3 illustrate a front, back and schematic block diagram, respectively, of a visual back-up guidance device 10 (spotter device) in accordance with one embodiment of the invention. As shown, the device 10 can be operated by a spotter to provide instructions to the driver and includes an outer shell/body 11 for housing a processor 12 that is conventionally connected to an internal memory 13, a plurality of visual indicators 14, a speaker 15, a plurality of control inputs 16, a power source 17 and an optional transmitter 18.

The main body 11 can take any number of distinct shapes, and can be constructed from any number of known materials and methods. In one preferred embodiment, the main body 11 can be constructed from injected plastic that includes a front side 11*a*, a back side 11*b*, a top side 11*c*, a bottom side 11*d* and a pair of opposing side surfaces 11*e* and 11*f*, defining a generally hollow waterproof interior space for positioning each of the elements 12-18 in a secure manner. Additionally, the main body can preferably include a brightly colored exterior such as neon orange, for example, which can assist a user to locate the device. Of course, other known materials and manufacturing processes are also contemplated.

The processor 12 can act to execute program code stored in the memory 13 in order to allow the device to perform the functionality described herein. Processors are extremely well known in the art, therefore no further description will be provided.

Memory 13 can act to store operating instructions in the form of program code for the processor 12 to execute. Although illustrated in FIG. 3 as a single component, memory 13 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, memory 13 can also include one or more cache memories that provide temporary storage of at least some program code in order to reduce the number of times program code must be retrieved from the bulk storage device during execution. Each of these devices is well known in the art.

A plurality of indicators 14 can function to provide a visual guide to the vehicle driver. In the preferred embodiment, visual indicators 14 can include a left turn indicator 14*a*, a GO indicator 14*b*, a STOP indicator 14*c*, a right turn indicator 14*d* and a distance indicator 14*e*. Each of the indicators 14*a*-14*e* can include one or more high yield Light-Emitting Diodes (LED) having any number of different colors. For example, indicators 14*a* and 14*d* can preferably include yellow colored LED's, indicator 14*b* can preferably include green colored LED's, indicator 14*c* can preferably include red colored LED's, and indicator 14*e* can preferably include both green, yellow and red LED's arranged from left (A') to right (B') across the front of the device 11*a* as shown in FIG. 1. Of course, any number of other lighted devices and colors can also be utilized herein.

At least one speaker 15 can function to provide an audible alarm in cases where it is necessary to rapidly attract the attention of the driver. To this end, the speaker 15 can be positioned anywhere along the main body 11, and can function to broadcast any audible sound such as an alarm bell, siren or other such sound.

A plurality of control inputs 16 function to activate each of the visual indicators and speaker described above. In one preferred embodiment, the control inputs can include push buttons 16*a*, 16*b*, 16*c*, 16*d* and 16*f*, each corresponding to visual indicators 14*a*, 14*b*, 14*c*, 14*d*, and the speaker 15, respectively. A slide switch 16*e* can function to control the operation of the distance indicator 14*e*. To this end, a spotter can utilize the switch 16*e* to indicate when a driver is far away from the desired location (A and A' showing green lights) and when the driver is close to the desired location (B and B' showing red lights). Such a feature functions as a distance-to-destination countdown for a driver to gauge the remaining distance to the location.

In one embodiment, the slide switch 16*e* can also function to operate the GO indicator 14*b* when the switch is not adjacent to edge B, and can automatically activate the STOP indicator 14*c* and/or alarm 15 when the switch is adjacent to edge B.

In one preferred embodiment, the power source 17 can include one or more DC batteries capable of providing the necessary power requirements to each element of the device 10. The batteries can be replaceable, rechargeable or integrated into the device in accordance with known manufacturing processes.

In operation, a spotter can stand behind the vehicle holding the visual back-up guidance device 10 wherein the front side 11*a* is visible to a driver through a window or mirror. As the driver backs the vehicle into the designated area, the spotter can operate the control inputs 16 which correspond to visual instructions 14 that are viewable to the driver, as described above.

Although described as utilizing specific components and having specific indicators, this is for illustrative purposes only, as any number of variations can be made to the present device without undue experimentation. For example, the functionality of the processor and/or memory can be replaced by any number of solid state circuits, for example, or other such technology sufficient to allow user inputs 16 to be received, and user outputs 14 and 15 to be sent. Moreover, as the device will be viewed by a driver through a mirror, one alternate embodiment of the invention (not illustrated) can include markings that are written in mirror image so as to be readable by the driver through a mirror.

Figure 4:
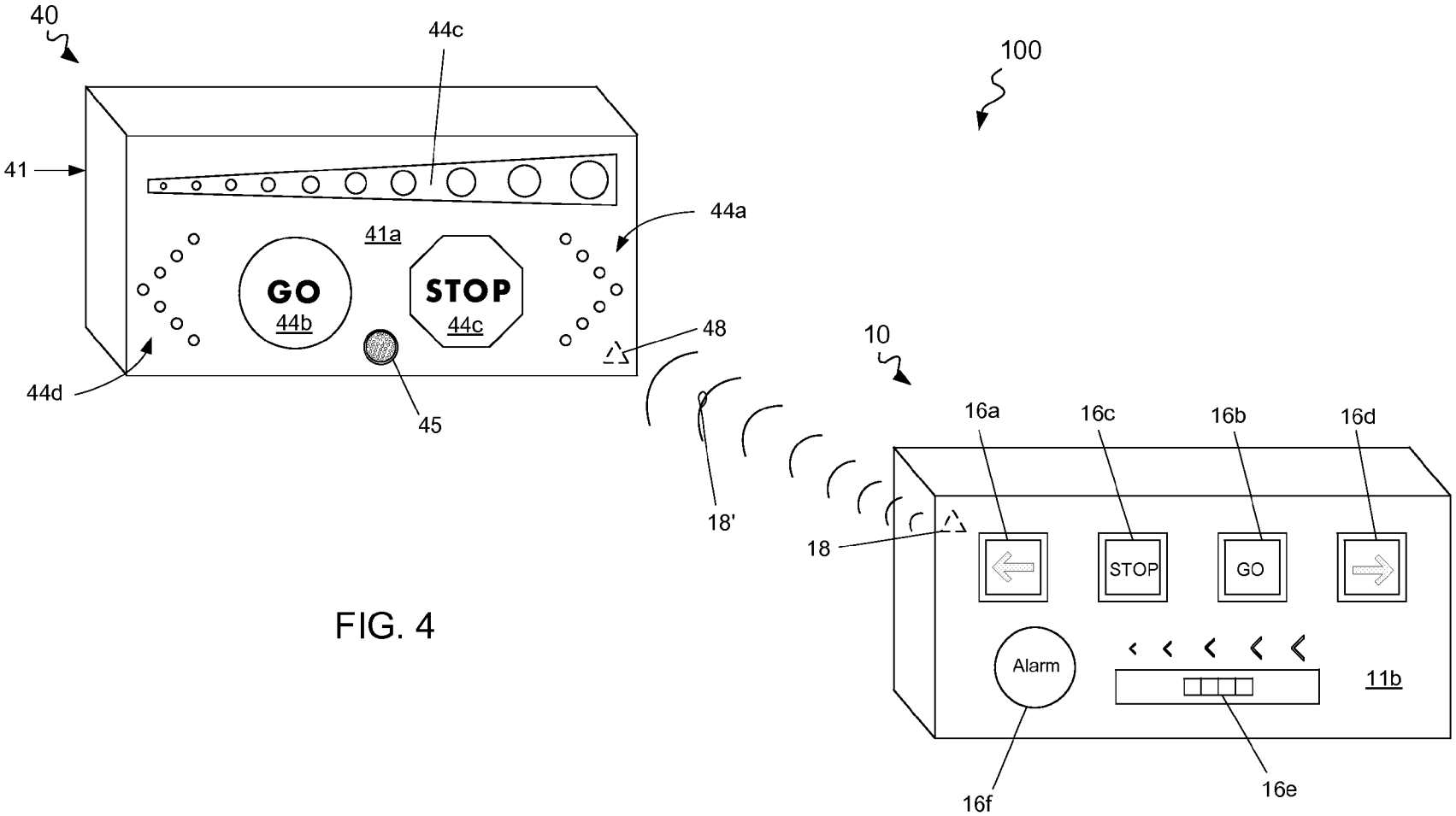
FIG. 4 is a perspective view of a visual back-up guidance system for trailers and vehicles, in accordance with one embodiment of the invention.

FIG. 4 illustrates one embodiment of a visual back-up guidance system 100 utilizing the device 10 described above and a separate driver receiver unit 40. In the present embodiment, the device 10 includes the optional transmitter 18 (See FIG. 3) for providing visual instructions to be displayed on the driver unit 40.

The driver unit 40 can include a main body 41 for housing a processor 42 that is conventionally connected to an internal memory 43, a plurality of visual indicators 44, a speaker 45, a power source 47 and a receiver 48. Although not shown, an additional connector such as double sided tape and/or strips of hook and loop material, for example can be disposed along a back surface of the driver unit to facilitate mounting to the vehicle dashboard during use.

As described herein, elements 41-47 can be essentially identical to elements 11-17, respectively, which are described above in detail, and can serve the exact same functionality.

In one embodiment, the transmitter 18 can be disposed within the device 10, and can act to transmit a signal from the device 10 to the driver unit 40. These signals can correspond to any of the inputs 16*a*, 16*b*, 16*c*, 16*d*, 16*e* and 16*f*, each corresponding to the visual indicators 44*a*, 44*b*, 44*c*, 44*d*, 44*e* and the speaker 45, respectively on the driver unit. In one preferred embodiment, the transmitter can include a variable radio wave transmitter having a unique radio frequency chip capable of transmitting a plurality of independent radio frequencies 18' which are stored in the memory 12.

The receiver 48 can act to receive a signal from the device 10. In one preferred embodiment, the receiver can include a variable radio wave receiver having a unique radio frequency chip capable of receiving and translating a plurality of independent radio frequencies 18', which can be sent to the driver processor 42 and/or the driver unit memory 43.

Although described above as using radio transmission, reception and frequencies, other communication mediums and their associated components are also contemplated. For example, infrared (IR), Bluetooth, RFID, microwave and other known communication mediums can also be utilized without deviating from the scope and spirit of the inventive concepts disclosed herein.

In operation, the system 100 can function to allow a spotter to communicate visual instructions to assist a user with backing trailers and other such vehicles. The system 100 functioning to provide a driver with two separate visual and/or audible communicators in the form of the device 10 and the driver unit 40 so as to allow the driver to receive the instructions when they are facing forward or looking backwards through a mirror or window, for example.

Accordingly, the device 10 and system 100 provide a novel means for communicating instructions to a driver while backing a trailer or other such vehicle.

As described herein, one or more elements of each of the device 10 and driver unit 40 can be constructed in accordance with any known construction methodologies and can utilize any number of known attachment means such as, for example, screws, glue, compression fittings and welds, among others. Moreover, although the above embodiments have been described as including separate individual components, the inventive concepts disclosed herein are not so limiting, as functional components can be merged, and analogue circuits can also be provided to perform equivalent functions as the above described components.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A visual back-up guidance device for trailers and vehicles, said device comprising:

a durable main body having a front side and a back side;

a plurality of visual indicators disposed along the front side of the main body, each of said indicators functioning to provide a visual instruction to a user;

at least one speaker disposed along the main body; and a plurality of control inputs disposed along the back side of the main body, each of the plurality of control inputs functioning to control an operation of at least one of a single visual indicator, and the speaker.

2. The device of claim 1, wherein the plurality of visual indicators includes:

a left turn indicator, a GO indicator, a STOP indicator, and a right turn indicator.

3. The device of claim 2, wherein:

the left turn indicator includes a plurality of yellow LED's in the shape of an arrow pointing left across the front surface of the main body;

the GO indicator includes a plurality of green LED's in the shape of a circle;

the STOP indicator includes a plurality of red LED's in the shape of a stop sign; and the right turn indicator includes a plurality of yellow LED's in the shape of an arrow pointing right across the front surface of the main body.

4. The device of claim 3, wherein the plurality of control inputs includes a left turn button, a GO button, a Stop button, a right turn button, and a speaker button, said buttons functioning to control an operation of the left turn indicator, the GO indicator, the Stop indicator, the right turn indicator, and the speaker, respectively.

5. The device of claim 2, further comprising:

a distance indicator that includes a plurality of green, yellow and red LED's, said indicator functioning to provide a visual distance-to-destination countdown to a user.

6. The device of claim 5, wherein the plurality of control inputs further includes:

a slide switch functioning to control an operation of the distance indicator.

7. The device of claim 6, wherein the slide switch is further configured to control an operation of the STOP indicator, the GO indicator and the speaker.

8. The device of claim 1, further comprising:

a processor and at least one physical memory that are communicatively linked to each of the plurality of visual indicators, the at least one speaker and each of the plurality of control inputs; and a transmitter functioning to transmit a signal corresponding to each of the plurality of control inputs.

9. The device of claim 8, further comprising:

a driver receiver unit that includes:

a durable driver unit main body having a front side and a back side;

a plurality of visual indicators disposed along the front side of the driver unit main body, said indicators including a left turn indicator, a GO indicator, a STOP indicator, and a right turn indicator;

at least one speaker; and a receiver functioning to receive the signal from the transmitter and to operate a corresponding visual indicator.

10. A visual back-up guidance system for trailers and vehicles, said system comprising:

a guidance device that includes a durable main body having a front side and a back side, a first plurality of visual indicators disposed along the front side of the main body, each of said indicators functioning to provide a visual instruction to a user, at least one speaker disposed along the main body, a plurality of control inputs disposed along the back side of the main body, and a transmitter; and a driver receiver unit that includes:

a durable driver unit main body having a second plurality of visual indicators disposed thereon, at least one speaker, and a receiver configured to receive a wireless signal from the transmitter.

11. The device of claim 10, wherein each of the first and second plurality of visual indicators includes a left turn indicator, a GO indicator, a STOP indicator, a right turn indicator, and a distance indicator.

12. The device of claim 11, wherein:

each of the left turn indicators includes a plurality of yellow LED's in the shape of an arrow pointing left across the front surface of the main body;

each of the GO indicators includes a plurality of green LED's in the shape of a circle;

each of the STOP indicators includes a plurality of red LED's in the shape of a stop sign;

each of the right turn indicators includes a plurality of yellow LED's in the shape of an arrow pointing right across the front surface of the main body; and each of the distance indicators include a plurality of green, yellow and red LED's, functioning to provide a visual distance-to-destination countdown to a user.

13. The device of claim 12, wherein the plurality of control inputs includes a left turn button, a GO button, a Stop button, a right turn button, a speaker button, and a slide switch said buttons functioning to control an operation of each of the left turn indicators, the GO indicators, the Stop indicators, the right turn indicators, and the speakers, respectively, and the slide switch functioning to control an operation of the distance indicators.

14. The device of claim 13, wherein the slide switch is further configured to control an operation of each of the STOP indicators, the GO indicators and the speakers.

* * * * *